United States Patent [19]

Brands et al.

[11] 4,108,706

[45] Aug. 22, 1978

[54] LABELLING MACHINE

[75] Inventors: Jacobus Brands, Eindhoven, Netherlands; Kurt Thaddey, Buchs, Switzerland

[73] Assignee: Prontophot Holding AG, Dubendorf, Switzerland

[21] Appl. No.: 800,874

[22] Filed: May 26, 1977

[30] Foreign Application Priority Data

Jun. 2, 1976 [CH] Switzerland ..... 6926/76

[51] Int. Cl.[2] ..... B65C 9/02; B65C 9/18

[52] U.S. Cl. ..... 156/384; 83/341; 83/345; 83/348; 156/521; 156/540; 156/568; 156/DIG. 33

[58] Field of Search ..... 156/384, 517, 521, 540, 156/571, DIG. 33, DIG. 36, 510, 519, 568; 83/341, 343, 345, 348, 267

[56] References Cited

U.S. PATENT DOCUMENTS

| | | | |
|---|---|---|---|
| 2,449,298 | 9/1948 | Hoppe | 156/568 |
| 2,483,458 | 10/1949 | Fischer et al. | 156/521 |
| 2,543,220 | 2/1951 | Ardell | 156/521 |
| 3,577,293 | 5/1971 | Ritterhoff | 156/521 X |
| 3,586,586 | 6/1971 | Berg | 156/519 X |
| 3,750,511 | 8/1973 | Toensing | 83/348 X |
| 4,035,808 | 7/1977 | Karp | 156/540 X |

*Primary Examiner*—Michael G. Wityshyn
*Attorney, Agent, or Firm*—Watson, Cole, Grindle & Watson

[57] ABSTRACT

A labelling machine comprises feed rollers which are driven stepwise to draw lengths of tape from a tape reel and to feed same to a transfer roller. Each length of tape is severed by co-operating cutter means on the transfer roller and on a pivotal arm adjacent the transfer roller. The severed length, which forms the label, is fed stepwise by the transfer roller to a label-applying station. During the stepwise movement the label is held on the transfer roller, for example by vacuum.

8 Claims, 6 Drawing Figures

LABELLING MACHINE

BACKGROUND OF THE INVENTION

1. Field of the Invention.

The present invention relates to labelling machines.

2. Description of the Prior Art.

For the labelling of round containers such as bottles there may be used, if the number of bottles is sufficiently large, automatic labelling machines in which printed labels stacked in a magazine are removed individually from the magazine and then provided with adhesive and applied to the bottles. Such machines are not easily adaptable to varying sizes of containers and different sizes of labels.

SUMMARY OF THE INVENTION

According to the present invention, there is provided in a labelling machine, a tape reel, a cyclically-operable feed device comprising feed rollers rotatable in opposite directions to draw a predetermined length of tape from the real and to feed such a length of tape during each cycle, a cyclically-operable transfer roller, means mounting the transfer roller for rotation about an axis parallel to the axes of the feed rollers, said transfer roller serving to transfer a label consisting of the said length of tape to an article which is to be labelled, the transfer roller having a periphery with flat areas uniformly spaced around the periphery, cutters arranged around the periphery, each said cutter having a cutting edge, the cutting edges being so arranged that in each rotary position of the transfer roller one of said edges lies in the plane of the tape which has been fed by the feed rollers to the transfer roller, a pivotal arm, a counter-cutter, means movably mounting the counter-cutter on the arm, said arm being cyclically driven whereby said counter-cutter co-operates with a said cutter on the transfer roller to sever the length of tape, and means for temporarity holding the severed length of tape on the transfer roller.

In a preferred embodiment of the invention, the travel of the tape can be adjusted by the feed device in order to alter the tape length which is to be pulled off from the reel. As a result, labels of various lengths can be produced from the same tape reel.

A printing mechanism for printing the tape may be arranged between the reel and the feed device. In this way there is obtained the possibility of being able to quickly reset the machine to apply different data to the label which may also have a different size. Preferably in order that the machine may be used not only with normal paper tapes and tapes of so-called heat-seal papers, but also with tapes of self-adhesive paper which on the adhesive side are covered by a silicone backing paper, there is provided for the purpose of detaching the silicone backing paper, a separating device consisting of a wedge and direction-changing rollers, by means of which device, in the course of the further feed of the tape, the silicone paper is detached from the adhesive side of the tape. Accordingly, substantially all suitable kinds of paper may be used with this machine.

BRIEF DESCRIPTION OF THE DRAWINGS

An embodiment of the invention, will now be described, by way of example only, with reference to the accompanying diagrammatic drawings, in which.

DESCRIPTION OF THE PREFERRED EMBODIMENT

Figure 1:
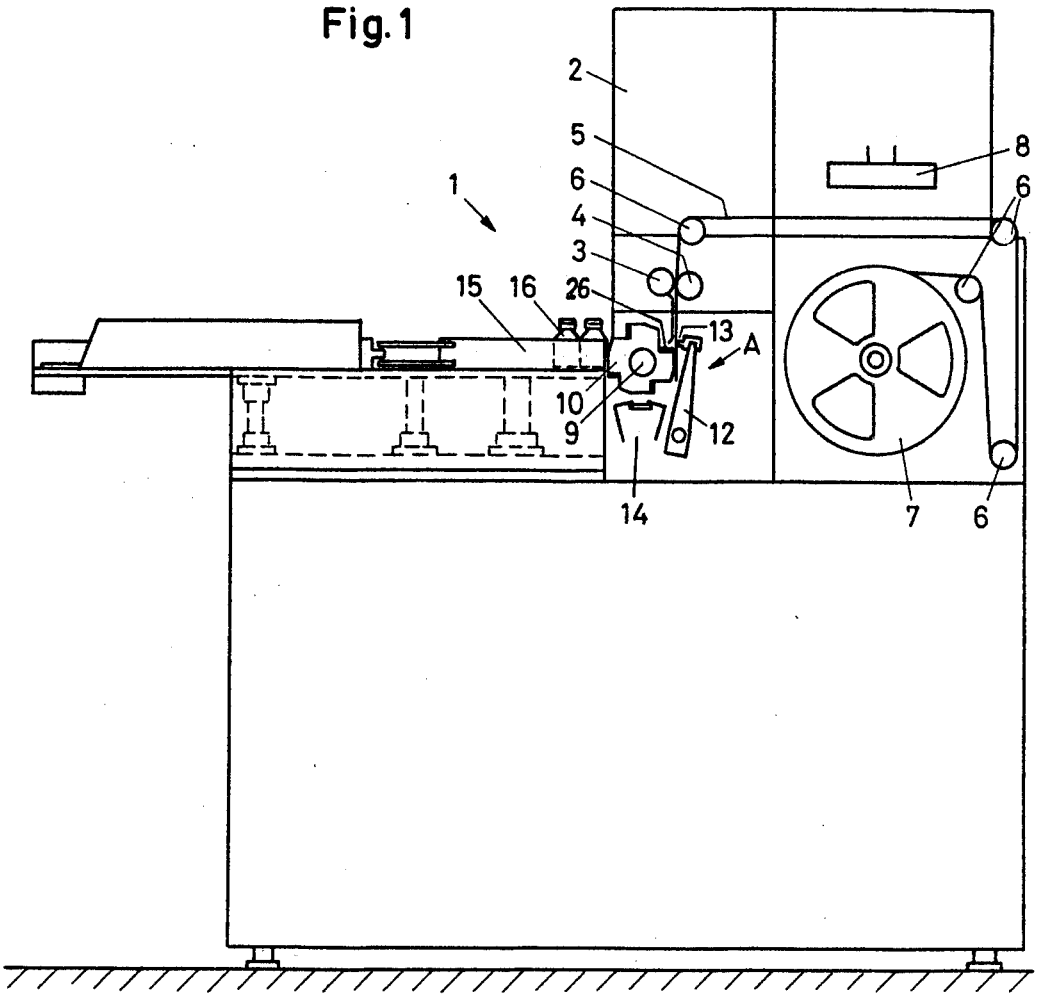
FIG. 1 is a side elevation of a labelling machine in accordance with the present invention.
Figure 2:
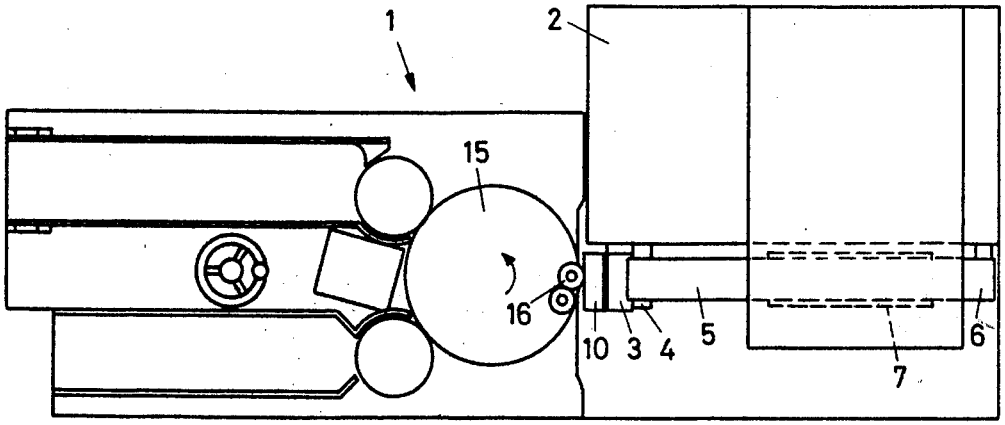
FIG. 2 is a plan view of the machine.
Figure 6:
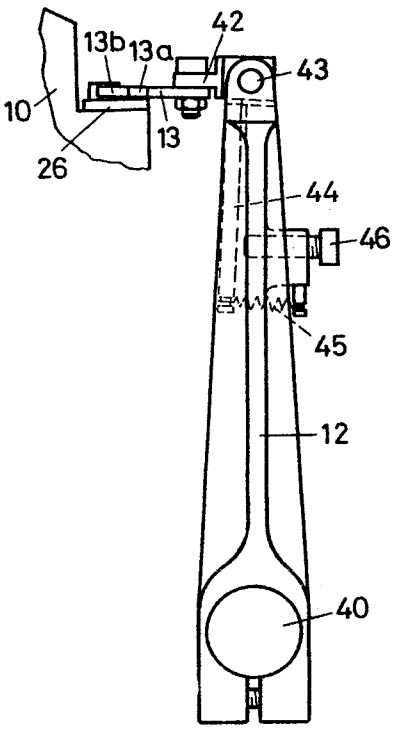
FIGS. 5 and 6 show the tape cutting means in two different positions.
Figure 5:
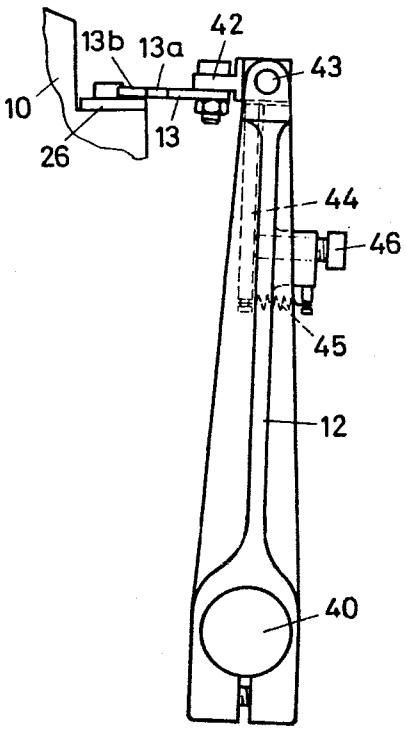

With initial reference to FIGS. 1 and 2, the labelling machine comprises an upper gearbox 2 containing a drive mechanism (not shown). The drive mechanism is operative to drive cyclically or stepwise a feed device which consists of feed rollers 3 and 4 for feeding a paper tape 5. The tape 5 passes between the feed rollers via several guide rollers 6, from a tape reel 7. Above the path of the paper tape 5 between the reel 7 and the feed rollers is a printing mechanism 8 for printing the paper tape so that, after cutting the paper tape, finished labels are obtained. The drive mechanism for the guide rollers 3 and 4 is capable of being regulated so that the travel of the paper tape can be variously adjusted according to the desired length of the label. For a specific size of label the same paper tape length is always drawn from the reel by the feed rollers 3 and 4. The transporting rollers 3 and 4 rotating in opposite directions are, in known manner, coupled with engaged toothed wheels, the diameter of the pitch circle of the toothed wheels being equal to the diameter of the rollers.

The paper tape 5 is fed vertically by the feed rollers 3 and 4 to a cutting station laterally beside a transfer roller 10 rotating cyclically or stepwise about a horizontal axis 9 below the feed rollers. The transfer roller 10 is equipped with cutters 26 distributed uniformly over its periphery. With a respective cutter present at the cutting station in the plane of the paper tape 5 there co-operates a counter-cutter 13 arranged on a pivotal arm 12 in order to separate from the paper tape 5 a length of paper tape determined by the advance of the feed rollers.

This length of paper tape, which forms the label, is held on the transfer roller by a device (not shown in FIGS. 1 and 2) for generating a vacuum at the transfer roller 10. The transfer roller is then further rotated by 90° in a clockwise direction to locate the label at a station having a device 14 for applying adhesive to the label when this consists of normal paper, or for activating by heat an adhesive layer present on the label when heat-seal paper is used. After a further rotation of the transfer roller by 90°, the label, still held on the roller by vacuum, arrives at at label-applying station directly in front of an article such as an ampoule or bottle 16 fed by a circular turntable 15. The label is thus adhered to the article and is thereby removed from the transfer roller.

Figure 3:
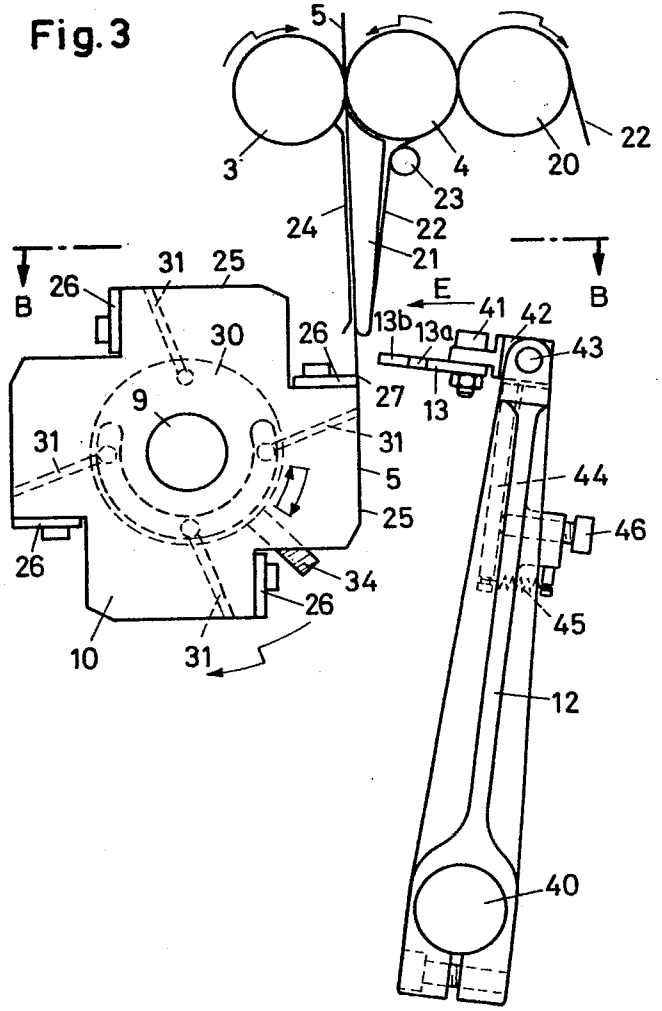
FIG. 3 shows to an enlarged scale and in greater detail means (designated as A in FIG. 1) for feeding and cutting the tape.
Figure 4:
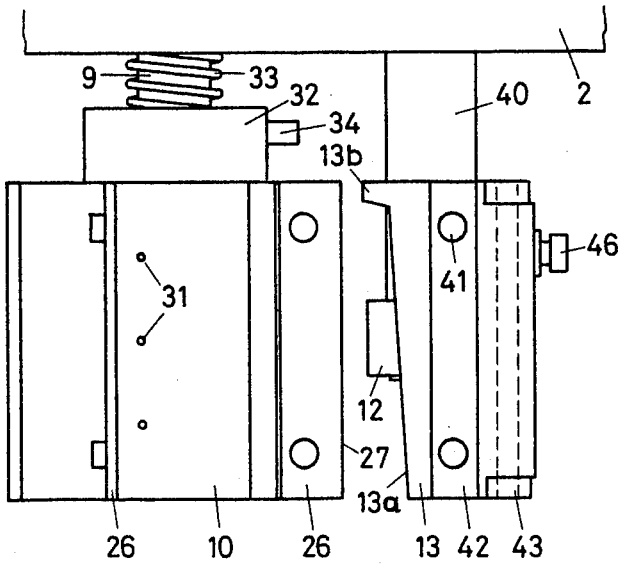
FIG. 4 is a plan view taken along line B — B of FIG. 3.

The various components of the machine are shown in greater detail in FIGS 3 to 6. In FIG. 3 there is shown, on the right-hand side of the feed rollers 3 and 4, a further roller 20 which, together with a wedge 21 arranged below the feed roller 4, serves for detaching a silicone backing paper 22 in strip form which covers the adhesive side of self-adhesive paper when self-adhesive paper is used. The separation of the self-adhesive paper tape from the silicone backing paper occurs at the lower edge of the wedge 21 and the separated backing paper then passes over a stationary guide 23, the backing paper being drawn by the rollers 4 and 20. The roller 20 is also driven by a toothed wheel (not shown) in engagement with the other toothed wheels; in this case, however, the diameter of the roller 20 is larger than the pitch circle of the toothed wheel in order to ensure that the backing paper always remains tensioned. The roller 20 is resiliently pressed against the roller 4 by means of an eccentric (not shown).

Through the addition of the roller 20 and wedge 21 to the machine (for simplification of the drawing, these components have been omitted from FIGS. 1 and 2), it is therefore possible to use, besides the already mentioned normal paper and heat-seal paper, self-adhesive paper. Parallel to the wedge 21 there is arranged a tape guide 24 in order to hold the paper tape in a flat condition.

The paper tape 5 fed by the feed rollers 3 and 4 subsequently arrives at the cutting station laterally beside the transfer roller 10 to lie against a flattened peripheral area 25 of this roller. The transfer roller has at its periphery four such flattened peripheral areas 25 each angularly offset from an adjacent area by 90°. In order to form the peripheral areas 25, the roller 25 has a step-shaped periphery. In each step a cutter 26 is so arranged that the cutting edge 27 of the cutter is flush with the outer peripheral surface of the roller and also lies in the plane of the paper tape. The cutters 26 have straight cutting edges and can therefore be used by rotation with all four edges. The transfer roller 10 is cyclically rotated clockwise through steps of 90° by means of a mechanism (not shown) comprising a Geneva cross and toothedwheel. The transfer roller further has an internal hollow space 30 and bores 31 which lead from this space to each of the flattened peripheral areas 25. Vacuum can be applied to each of the bores 31 via the hollow space 30 and a rotary vacuum valve 32 (see FIG. 4) arranged axially at the end face of the transfer roller. As can be seen from FIG. 4 each peripheral area 25 has several such bores 31 provided one beside another axially of the roller 10. The rotary vacuum valve 32 is pressed against the end face of the transfer roller 10 by a spring 33 and is connected to a vacuum source (not shown) via a connecting pipe 34. The vacuum valve 32 is so rotated by the drive mechanism that vacuum prevails in the bores 31 only when the advance of the paper tape has ended.

In order to cut off from the paper tape 5 the required length of paper tape, the counter-cutter 13 which is movably mounted on the pivotal arm 12, is brought into co-operation with the cutter 26 located at the cutting station. In FIGS. 3 to 6, three different positions of the arm 12 are shown. The arm is secured to an oscillatory axle 40 which extends outwardly from the gearbox 2 of the machine. The counter-cutter 13 is secured by means of screws 41 to a cutter holder 42 which is pivotally secured to the arm 12 by means of a pivot 43. The movement of the cutter holder is limited. A rod 44 which is rigidly joined to the cutter holder and which extends downwardly at a right angle to the plane of the counter-cutter 13 is pressed against an adjustable stop screw 46 by means of a spring 45 so that the counter-cutter can pivot upwardly about the pivot against the action of the spring 45. By means of the stop screw the position of the counter-cutter relative to the cutter 26 at the cutting station can be accurately adjusted. The axle 40 of the arm 12 is so arranged that, during the pivotal movement of the arm 12, the counter-cutter 13 describes a somewhat obliquely downwardly directed movement as is indicated by the arrow E. The counter-cutter 13 has, at its forward end, a supporting tongue **13*b* which projects with respect to the cutting edge 13*a* of the counter-cutter. The cutting edge 13*a* is so constructed that, from the supporting tongue, it extends obliquely backwards. The arm 12 with its axle 40 is so arranged that, during the obliquely downwardly directed movement (indicated by the arrow E) between the cutter 26 and the front side of the supporting tongue 13*b*, when the latter has arrived above the cutter 26 there still remains a small gap having a width of about 2 mm which is necessary because the transfer roller 10 during its stepwise rotation cannot accurately be brought exactly into the required positions because of the inherent play in the drive mechanism. As can be seen from FIGS. 5 and 6, during the further pivotal movement of the arm 12, initially only the supporting tongue 13*b* touches the cutter 26 at the cutting station. During subsequent movement of the arm 12, the counter-cutter 13 which is secured to the cutter holder 42 which is pivotal about the pivot 43, can now move upwards against the action of the spring 45 when the cutting edge 13*a* of the counter-cutter reaches the cutter 26. From FIG. 6 it can be seen that the rod 44 is then raised from the stop screw 46. The counter-cutter 13 is accordingly taken resiliently over the cutting edge 27 of the cutter 26** so that the cutting edges of the two cutters touch one another negatively. The movable mounting of the counter-cutter and the position of the pivot for the pivotal movement are decisive for the achievement of a faultless cut at a counter-edge which cannot always be accurately fixed in the same position.

After a label is separated from the paper tape it is held by vacuum on the transfer roller 10 in the manner described above and, after further rotation of the transfer roller, the label is provided with adhesive by means of the device 14 already described with reference to FIG. 1, or the adhesive coating already present on the label is activated by heat by the device 14, so that the label can then, after further rotation of the transfer roller, be taken off by an ampoule or bottle 16 or other article present on the table 15.

What is claimed is:

1. In a labelling machine having a tape reel, a feed device comprising feed rollers for drawing tape from the reel and feeding it to a cutting device, and means serving to transfer a label which comprises a cut length of the tape to an article which is to be labelled, the improvement comprising, a cyclically operable printing device for printing the tape and being arranged between the reel and the feed device, driving means for cyclically operating feed rollers of the feed device to draw a predetermined length of tape from the reel during each cycle of the machine, a transfer roller to which such a length of the tape is fed by the driving means, said transfer roller having a periphery with four flat areas each angularly displaced by 90° from an adjacent flat area, the periphery of said transfer roller being cut-back between adjacent flat areas to define a step, and four cutters each arranged in a respective one of the steps such that the cutting edge of each cutter is flush with the periphery of the transfer roller, said transfer roller being rotatable stepwise through angular steps of 90° such that in each rotary position of the transfer roller one of the flat areas and one cutting edge of the cutters lies in a common plane with the tape which has been fed by the feed rollers to the transfer roller, a pivotal arm and means for movably mounting a counter-cutter on the arm being arranged opposite to said one flat area and said one cutting edge, said arm being cyclically driven whereby said counter-cutter cooperates with a said cutter on the transfer roller to sever a length of tape and thereby defining a cutting station, the transfer roller having an internal hollow space being connected to a source of vacuum and having radially extending bores leading from the internal space to the flat peripheral areas for holding thereon by vacuum the severed length of tape, a station for transferring a label comprising the severed length of tape to an article which is to be labelled, said transfer roller feeding such length of tape by the cyclically operable transfer roller directly to said transfer station, said transfer station being arranged with respect to the rotary direction of the transfer roller across from the pivotal arm, and said transfer station comprising means for feeding an article to be labelled past the severed length of tape on the transfer roller, said feeding means serving to feed the article in an upright position parallel to the axis of the transfer roller so that the predetermined length of tape drawn from the reel and severed by the cutter and counter-cutter defines the height of the label on the article.

2. A machine according to claim 1, wherein the feed device is adjustable to vary the said predetermined length of tape.

3. A machine according to claim 1, said machine being adapted for use with a self-adhesive tape having a removable backing strip, said machine further comprising means for removing the backing strip from the tape, said removing means comprising a wedge located downstream of the feed rollers, said wedge having an edge, and feed roller means for drawing the backing strip around said edge to remove the backing strip from the tape.

4. A machine according to claim 1, further comprising a cutter holder pivotally mounted at an end of the arm, means securing the said counter-cutter to the cutter holder, adjustable stop means, and spring means biasing the cutter holder against the stop means, said cutter holder forming said counter-cutter mounting means.

5. A machine according to claim 4, wherein the counter-cutter has a cutting edge and a supporting tongue which projects with respect to the cutting edge, said supporting tongue being arranged during the cutting operation, to initially engage the cutter on the transfer roller, and the cutting edge of the counter-cutter extending obliquely from the supporting tongue.

6. A machine according to claim 1, further including another station comprising means for rendering the label adhesive, said another station being arranged, relative to the direction of rotation of the transfer roller, between the cutting station and the station for transferring a label so that three successive stations are distributed around the transfer roller, each station being displaced through 90° from an adjacent station.

7. A machine according to claim 6, wherein the means for rendering the label adhesive comprises means for applying an adhesive to the outer surface of the label held by the transfer roller.

8. A machine according to claim 6, wherein the means for rendering the label adhesive comprises means for activating an adhesive already present on the label.

* * * * *